US007467467B2

(12) United States Patent
Prociw

(10) Patent No.: US 7,467,467 B2
(45) Date of Patent: Dec. 23, 2008

(54) METHOD FOR MANUFACTURING A FOAM CORE HEAT EXCHANGER

(75) Inventor: Lev Alexander Prociw, Elmira (CA)

(73) Assignee: Pratt & Whitney Canada Corp., Longueuil (CA)

( * ) Notice: Subject to any disclaimer, the term of this patent is extended or adjusted under 35 U.S.C. 154(b) by 189 days.

(21) Appl. No.: 11/239,110

(22) Filed: Sep. 30, 2005

(65) Prior Publication Data

US 2007/0234565 A1 Oct. 11, 2007

(51) Int. Cl.
*B21D 53/02* (2006.01)

(52) U.S. Cl. ..... 29/890.041; 29/890.039; 29/890.03; 29/890.034

(58) Field of Classification Search ..... 29/889.03, 29/889.039, 889.041, 890.034, 890.03, 890.039, 29/890.041; 165/164, 166
See application file for complete search history.

(56) References Cited

U.S. PATENT DOCUMENTS

| | | | | |
|---|---|---|---|---|
| 2,448,315 | A | | 8/1948 | Kunzog |
| 3,289,756 | A | | 12/1966 | Jaeger |
| 3,322,189 | A | * | 5/1967 | Armenag ..... 165/8 |
| 3,401,798 | A | * | 9/1968 | Per ..... 210/321.74 |
| 3,444,925 | A | * | 5/1969 | Johnson ..... 165/166 |
| 4,089,370 | A | | 5/1978 | Marchal |
| 4,222,434 | A | * | 9/1980 | Clyde ..... 165/10 |
| 4,245,469 | A | | 1/1981 | Fortini et al. |
| 4,285,385 | A | | 8/1981 | Hayashi et al. |
| 4,898,234 | A | | 2/1990 | McGovern et al. |
| 5,029,638 | A | | 7/1991 | Valenzuela |
| 5,145,001 | A | | 9/1992 | Valenzuela |
| 5,231,968 | A | | 8/1993 | Siefkes |
| 5,267,611 | A | | 12/1993 | Rosenfeld |
| 5,326,537 | A | | 7/1994 | Cleary |
| 6,142,222 | A | | 11/2000 | Kang et al. |
| 6,397,450 | B1 | | 6/2002 | Ozmat |
| 6,411,508 | B1 | | 6/2002 | Kang et al. |
| 6,424,529 | B2 | | 7/2002 | Eesley et al. |
| 6,840,307 | B2 | | 1/2005 | Eesley et al. |
| 6,926,969 | B2 | | 8/2005 | Bohm et al. |
| 2002/0106743 | A1 | | 8/2002 | Wirtz |
| 2004/0226702 | A1 | | 11/2004 | Toonen et al. |

FOREIGN PATENT DOCUMENTS

| | | |
|---|---|---|
| EP | 0492031 | 7/1992 |
| GB | 2132330 | 7/1984 |
| JP | 62000795 | 1/1987 |
| JP | 7004874 | 1/1995 |
| WO | WO 02/063231 | 8/2002 |
| WO | WO-2004/089564 | 10/2004 |
| WO | WO-2005/037467 | 4/2005 |

OTHER PUBLICATIONS

Online definition for "Deformation", http://www.m-w.com/cgi-bin/dictionary?book=Dictionary&va=deformation.*

* cited by examiner

*Primary Examiner*—David P. Bryant
*Assistant Examiner*—Sarang Afzali
(74) *Attorney, Agent, or Firm*—Ogilvy Renault LLP

(57) ABSTRACT

A method for manufacturing a heat exchanger, including forming at least one flexible heat exchanging assembly with first and second adjacent conduits defined therein, shaping the flexible heat exchanging assembly, and heating the heat exchanging assembly to transform at least a portion of the flexible heat conducting material into a rigid heat conducting material.

6 Claims, 4 Drawing Sheets

METHOD FOR MANUFACTURING A FOAM CORE HEAT EXCHANGER

TECHNICAL FIELD

The invention relates generally to heat exchangers and, more particularly, to an improved foam core heat exchanger and related method of construction thereof.

BACKGROUND OF THE ART

Heat exchangers performing heat exchange between two fluids, for example a gas and a liquid, have been known to use porous foamed metal fins to augment the heat transfer area to volume ratio on the gas side of the heat exchanger. Such fins are usually molded by solidifying molten metal in separate molds or directly in cavities formed by rigid components of the heat exchanger. It is also known, particularly in heat sinks, to obtain a foam metal heat dissipating structure by sintering metal particles directly in cavities formed by rigid components of the heat sink. In both cases, the heat exchanger or heat sink usually has a rigid structure which cannot be easily manipulated to conform to a desired shape.

Heat exchangers in a gas turbine engine need to occupy a minimal volume and include conduits with a small cross-section which can resist considerably high temperatures and pressures while remaining lightweight. Spiral heat exchangers are known to occupy a minimal volume and are usually formed by rolling two long sheets of metal around a common axis. However, maintaining a small gap between adjacent layers of the spiral to obtain small cross-section conduits is usually very complex. In addition, such rollable spaced apart sheets of metals are usually not adapted to resist to considerably high pressures.

Known heat exchangers having high temperature and pressure capabilities include superposed, parallel rigid plates connected by intermediate walls. However, such a construction, while strong, is usually difficult to adapt to a spiral geometry in order to make most effective use of the space occupied by the heat exchanger.

Accordingly, there is a need to provide an improved heat exchanger which can be easily formed into a desired shape.

SUMMARY OF THE INVENTION

It is therefore an object of this invention to provide an improved heat exchanger.

In one aspect, the present invention provides A method of forming a heat exchanger comprising the steps of: forming a flexible heat exchanging assembly by: laying a first flexible sheet composed of heat conducting impermeable material on a support surface; laying a second flexible sheet composed of heat conducting impermeable material in a spaced apart manner over the first flexible sheet to define at least one elongated conduit for a first fluid flow between the first and second flexible sheets; and laying a third flexible sheet composed of flexible heat conducting foam on the second flexible sheet, the heat conducting foam having a plurality of interconnected pores defining a passage therethrough for a second fluid flow; shaping the flexible heat exchanging assembly into a desired shape; and bonding the flexible heat exchanging assembly together to form a rigid heat exchanger, the at least one conduit and the passage extending in a superposed manner throughout the heat exchanger in heat exchange relationship with one another.

In another aspect, the present invention provides a spiral heat exchanger comprising: at least one first spiralling conduit for directing a first fluid flow, the at least one first spiralling conduit extending between two pairs of opposed, spiralling sealed surfaces to define first and second open ends, the first open end being located near an outer circumference of the spiral heat exchanger, the second open end being located near a core of the spiral heat exchanger; a second spiralling conduit for directing a second fluid flow, the second conduit being adjacent the at least one first spiralling conduit and in heat exchange relationship therewith, the second spiralling conduit extending between two pairs of opposed, spiralling sealed surfaces to define third and fourth open ends, the third open end being located near the outer circumference, the fourth open end being located near the core, the second spiralling conduit including therein a heat conducting porous material permitting the second fluid flow to circulate therethrough.

In another aspect, the present invention provides a method for manufacturing a heat exchanger, the method comprising: forming at least one flexible heat exchanging assembly composed of flexible heat conducting material and having at least first and second adjacent conduits defined therein in heat exchange relationship with one another; shaping the at least one flexible heat exchanging assembly to a desired heat exchanger shape; and heating the at least one heat exchanging assembly to transform at least a portion of the flexible heat conducting material into a rigid heat conducting material and to rigidly bond the at least one flexible heat exchange assembly into the desired heat exchanger shape.

There is also provided, in accordance with another aspect of the present invention, a flexible heat exchanging assembly of a heat exchanger, the flexible heat exchanging assembly comprising: first means for conveying a first fluid flow, the first means being flexible and conducting heat; second means for conveying a second fluid flow, the second means being flexible and conducting heat, the first and second means being in heat exchange relationship such that heat is exchangeable between the first and second fluid flows, the second means including a porous flexible material transformable into a porous rigid material through heating such that the second means become rigid.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
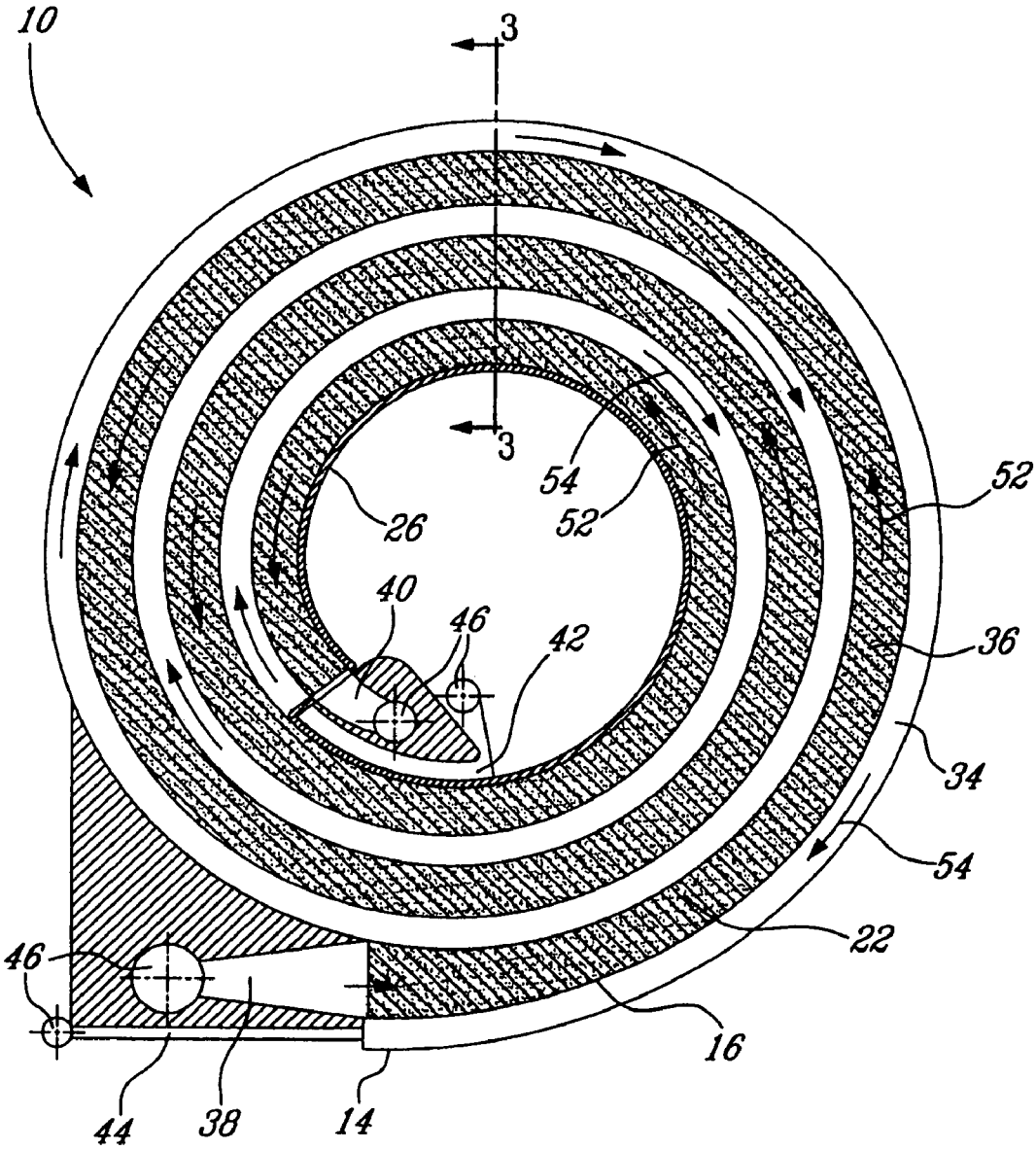
FIG. 1 is a side cross-sectional view of a heat exchanger according to an embodiment of the present invention.
Figure 2:
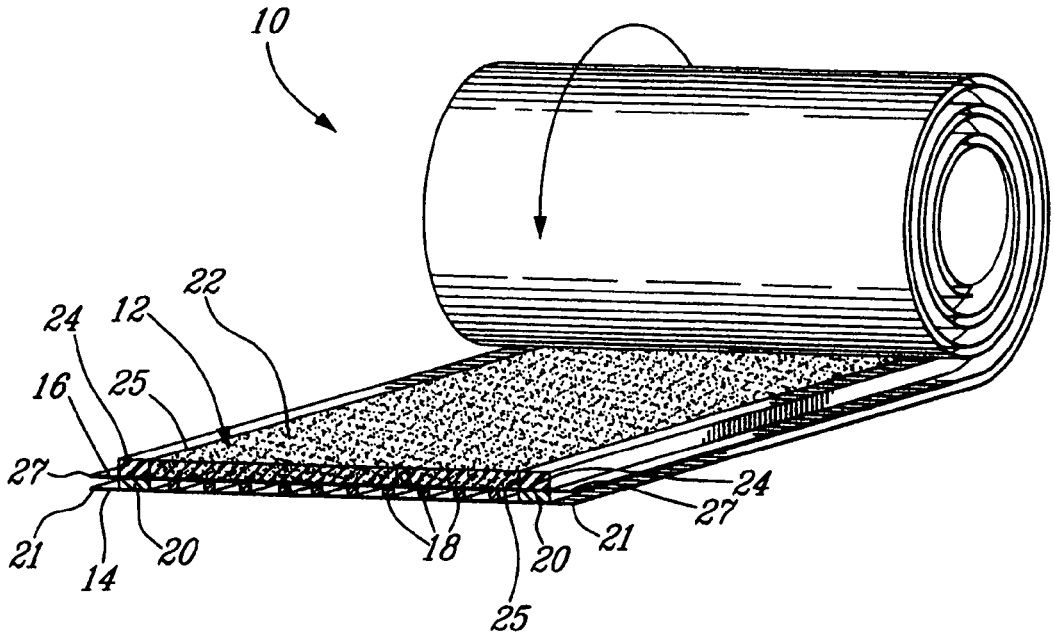
FIG. 2 is a perspective schematic view of a flexible heat exchanging assembly being rolled to form the heat exchanger of FIG. 1.
Figure 3:
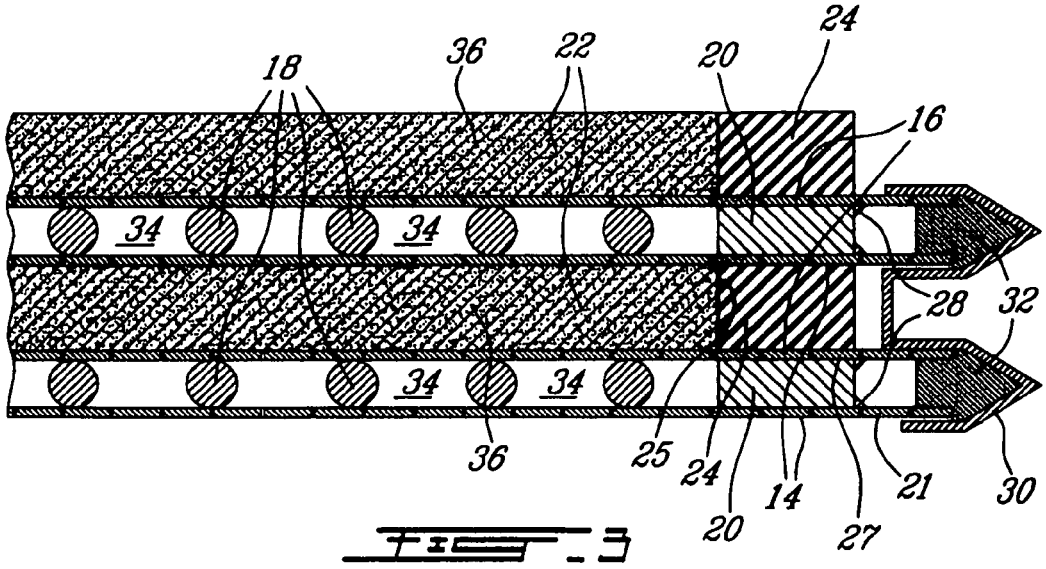
FIG. 3 is a cross-sectional view of the heat exchanger of FIG. 1 taken along line 3-3.

Referring to FIGS. 1 to 3, a heat exchanger 10 having a spiral configuration is shown. The heat exchanger 10 is formed by rolling a flat, flexible heat exchanging assembly 12 to a desired circumference. The heat exchanging assembly 12 preferably includes three superposed layers of sheet material: a first sheet of foil material 14, a second sheet of foil material 16, and a sheet of porous material 22.

The sheets of foil material 14,16 are maintained in a spaced apart manner by a plurality of parallel spacers 18 extending therebetween along a length thereof. Two flexible strips 20 extend parallel to the spacers 18 to connect and seal the elongated edges 21 of the sheets of foil material 14 with the elongated edges 27 of the sheet of foil material 16. The flexible strips 20 are offset from the elongated edges 21,27 such as to leave a portion of the sheets of foil material 14,16 extending beyond the strips 20. This assembly defines a plurality of parallel fluid conduits 34 defined between the inner surfaces of the sheets of foil material 14,16 in the free space between adjacent spacers 18 and between each flexible strip 20 and adjacent spacer 18. The fluid conduits 34 will take the form of spiralling conduits once the heat exchanging assembly 12 is rolled. Preferably, such fluid conduits 34 are adapted to receiving fuel flow therethrough, however other fluids such a suitable liquid for example may also be directed therethrough.

The sheets of foil material 14,16 are composed of a flexible, high strength, impermeable, heat conducting material resistant to high temperatures, preferably a nickel alloy foil. The spacers 18 are composed of a flexible material resistant to high temperatures, preferably in the form of wire or ribbons, and preferably also of a nickel alloy. The flexible strips 20 are also preferably composed of a nickel alloy. The sheets of foil material 14,16, spacers 18 and flexible strips 20 are compatible so that upon heating of the assembly they will adhere to one another, for example by pre-treating the spacers 18 and flexible strips 20 with an adequate high temperature alloy powder to permit the assembly to be sintered together.

The sheet of porous material 22 rests against the second, inner sheet of foil material 16 such that it is in heat exchange relationship therewith. One ribbon 24 seals each of the two elongated edges 25 of the sheet of porous material 22, with each ribbon 24 being preferably superimposed on a corresponding flexible strip 20 such as to form therewith an end plate of the heat exchanger 10. The sheet of porous material 22 includes a plurality of interconnected voids or pores and as such defines a wide air conduit 36 bordered by the two ribbons 24. The air conduit 36 will be a spiralling conduit once the heat exchanging assembly 12 is rolled. In the spiral form, the sheet of porous material 22 also rests against the first sheet of foil material 14 to be in heat exchange relationship therewith.

The sheet of porous material 22 is composed of a heat conducting material with coarse pores, resistant to high temperatures, that is flexible in its "green" state but which solidifies upon sintering or other similar treatment. A preferable material is a nickel based foam coated with a high temperature alloy powder, most preferably a 5% dense nickel foam powdered with an alloy which will react to form a nickel alloy foam upon sintering. U.S. Pat. No. 6,926,969 issued Aug. 9, 2005 to Bohm et al. and International Patent Application Publications WO2005/037467 and WO2004/089564, both to INCO Limited and respectively published on Apr. 28, 2005 and Oct. 21, 2004, disclose relevant materials and processes, and are incorporated herein by reference. The ribbons 24 are also preferably composed of a nickel alloy pre-treated with a high temperature alloy powder. The sheet of porous material 22 is compatible with the sheets of foil material 14,16 and with the ribbons 24 so that upon heating and solidifying the sheet of porous material 22 will adhere through sintering to the ribbons 24 and the first and/or second sheet of foil material 14,16, i.e. to the sheet it is in contact with. The superposed ribbons 24 and flexible strips 20, once adhered to the sheets of foil material 12,16, will form the end plate of the heat exchanger 10.

Braze paste 28 further seals the outer junctions between the sheets of foil material 14,16 and the flexible strip 20, to provide an additional protection against leaks. An end cap 30 containing fine pore metallic foam 32 encloses each of the elongated ends of the sheets of foil material 14,16 and also preferably the corresponding elongated end of the sheet of porous material 22, such as to catch any potential leaking fluid and direct it to where it can be detected. The metallic foam 32 serves to prevent a flame from forming if the leakage flow is a hot flammable fluid (such as fuel for example), such as by preventing flame propagation between adjacent pores of the foam material due to the limited pore size available, in the same manner that metallic screens and foams are well known to prevent flame propagation by, inter alia, repid conduction of energy away from the flame front. Such a flame retarding feature only becomes useful when the liquid used within the heat exchanger is a flammable one, such as fuel when the heat exchanger 10 is being employed as a fuel heater for example.

Figure 4:
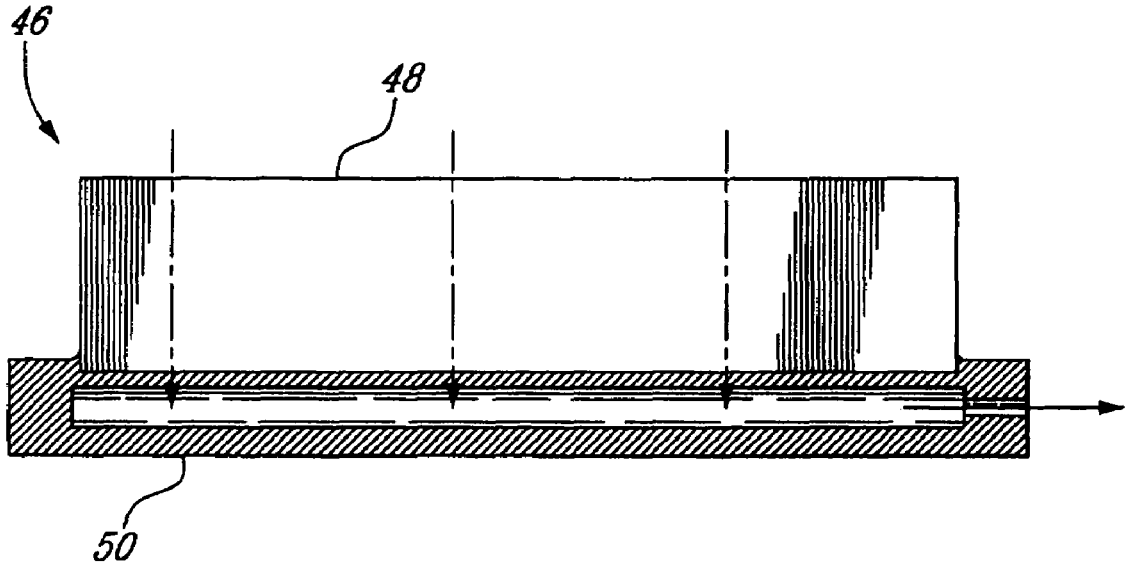
FIG. 4 is a top view of a manifold used in the heat exchanger of FIG. 1.
Figure 5:
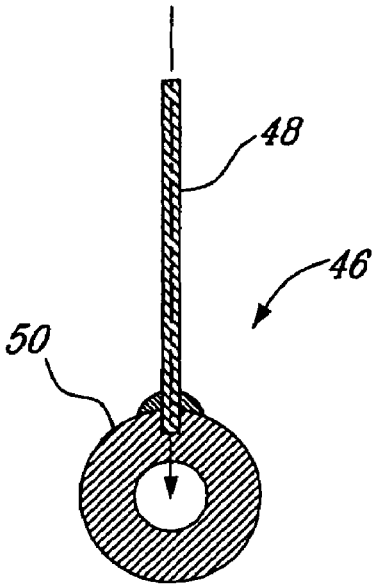
FIG. 5 is a side view of the manifold of FIG. 4.

The heat exchanger 10 also includes a core 26 which seals the portion of the sheet of porous material 22 located at the center of the heat exchanger 10. The core 26 includes an air outlet 40 connected at the end of the spiralling air conduit 36 and a liquid inlet 42 connected at the end of the spiralling fluid conduits 34. The liquid inlet 42 preferably acts as a fuel inlet when the liquid fed through the fluid conduits 34 is fuel. Along the outer circumference of the heat exchanger 10 is located an air inlet 38 connected to the other end of the spiralling air conduit 36 and a liquid outlet 44 connected to the other end of the spiralling fluid conduits 34. The air and liquid inlets and outlets 38,40,42,44 each include a manifold 46, an example of which is shown in further detail in FIGS. 4-5. The manifold 46 includes a planar duct 48, connected either to the air conduit 36 or to the plurality of fluid conduits 34 at one end, and to an end tube 50 at another end. A number of other manifold geometries are possible and would be applicable to the heat exchanger 10.

As shown in FIG. 1, the heat exchanger 10 is preferably a counter flow heat exchanger to maximise efficiency, with a spiralling airflow 52 directed opposite of a spiralling liquid flow 54. Of course, the heat exchanger 10 could also be used with parallel flows or different flow orientations.

The heat exchanger 10 is assembled according to the following. The first sheet of foil material 14 is laid flat on a support surface. The parallel spacers 18 and the two flexible strips 20 are placed on top of the first sheet of foil material 14, in a parallel regularly spaced apart manner, with the two flexible strips 20 located near the elongated edges 21 of the sheet. The second sheet of foil material 16 is placed over the spacers 18 and strips 20, with its elongated edges 27 in alignment with the elongated edges 21 of the first sheet of foil material 14. The sheet of porous material 22, bordered by the ribbons 24, is disposed over the second sheet of foil material 16. The flexible heat exchanging assembly 12 is thus formed as an unfastened "sandwiched" structure having two opposite exposed surfaces, namely one impermeable surface of the first sheet of foil material 14, and one permeable surface of the sheet of porous material 22. Because the metallic foam composing the sheet of porous material 22 is in its green state, thus flexible, the heat exchange assembly 12 can easily conform to a desired shape. Also, since the elements forming the heat exchanging assembly 12 are not fastened together, rolling or other shaping of the assembly 12 is facilitated, since the shaping of fastened elements can produce unwanted stress in the fastening means.

Preferable dimensions for the sheets of foil material 14,16 are about 10 feet long by one foot wide by 0.010 inches thick. Preferable dimensions for the sheet of porous material 22 are about 10 feet long by one foot wide by 0.2 inches thick. Preferable dimensions for the spacers 18 are about 10 feet long by 0.02 inches thick, placed 0.1 inches apart, center to center, such as to form fluid conduits 34 of 0.09 inches by 0.02 inches by 10 feet long. Of course, these dimensions are stated as an example only and it is understood that a variety of other appropriate dimensions can be used.

The flexible heat exchanging assembly 12, assembled as above in a flat "sandwiched" manner, is then rolled along its length to form a spiral shape, preferably around the core 26. Upon rolling the two exposed surfaces of the heat exchanging assembly 12 come into contact with each other, i.e. the sheet of porous material 22 abuts the first sheet of foil material 14. The spacers 18 maintain adequate spacing between the first and second sheets of foil material 14,16 during rolling.

The rolled heat exchanger 10 is then heated to a temperature (e.g. 2100-2300 degrees F.) adequate for converting the base foam material into a rigid foam and for sintering of certain elements together, as follows. The sheet of porous material 22, sandwiched between the first and second sheets of foil material 14,16, is sintered to both opposed foil sheets 14,16 abutted thereto, thus sealing its previously exposed larger surfaces. The ribbons 24 are sintered to the elongated edges 25 of the sheet of porous material 22, thus sealing them. Similarly, the strips 20 are sintered between the first and second sheets of foil material 14,16, sealing the gap therebetween. The spacers 18 are also sintered between the first and second sheets of foil material 14,16, thus defining the separate parallel fluid conduits 34.

The remaining unsealed portions between the layers are the two ends of the heat exchanging assembly 12, one extending axially in the center of the heat exchanger 10 and another extending axially at the outer circumference thereof. At the end located in the center, one manifold 46 is connected to the fluid conduits 34 to form the inlet 42 and one manifold 46 is connected to the air conduit 36 to form the air outlet 40. Such a connection can be, for example, through brazing of the manifolds 46 to the first and second sheets of foil material 14,16 and to the sheet of porous material 22. Similarly, at the end located at the outer circumference, one manifold is connected to the fluid conduits 34 to form the outlet 44 and one manifold 46 is connected to the air conduit 36 to form the air inlet 38. The braze paste 28 is added at the outer junctions between the sheets of foil material 14,16 and the flexible strip 20, and the heat exchanger 10 is reheated in a braze furnace. The end caps 30 are connected to the elongated ends of the first and second sheets of foil material 14,16.

The heat exchanger 10 thus formed is lightweight and robust. The spacers 18 sintered to the sheets of foil material 14,16 allow the sheets to resist to the high pressure, rapid liquid flow (e.g. 1500 psig, 10,000 lbs/hr). The sheet of porous material 22 can resist to high pressure, rapid air flow (e.g. 40 atmospheres, 20,000 lbs/hr). The preferred materials (nickel based) allow the conduits 34,36 to support high temperatures (e.g. 600 degrees F. on the liquid (fuel) side and 1200 degrees F. on the air side). Because of the porous material, the heat exchanger 10 absorbs at least most vibrations to which it is exposed and has high strength, while occupying a minimal volume because of its spiral configuration. As such, it can advantageously be used in a gas turbine engine, for example to take advantage of the thermal heat sink available in fuel to cool turbine cooling air.

Figure 6:
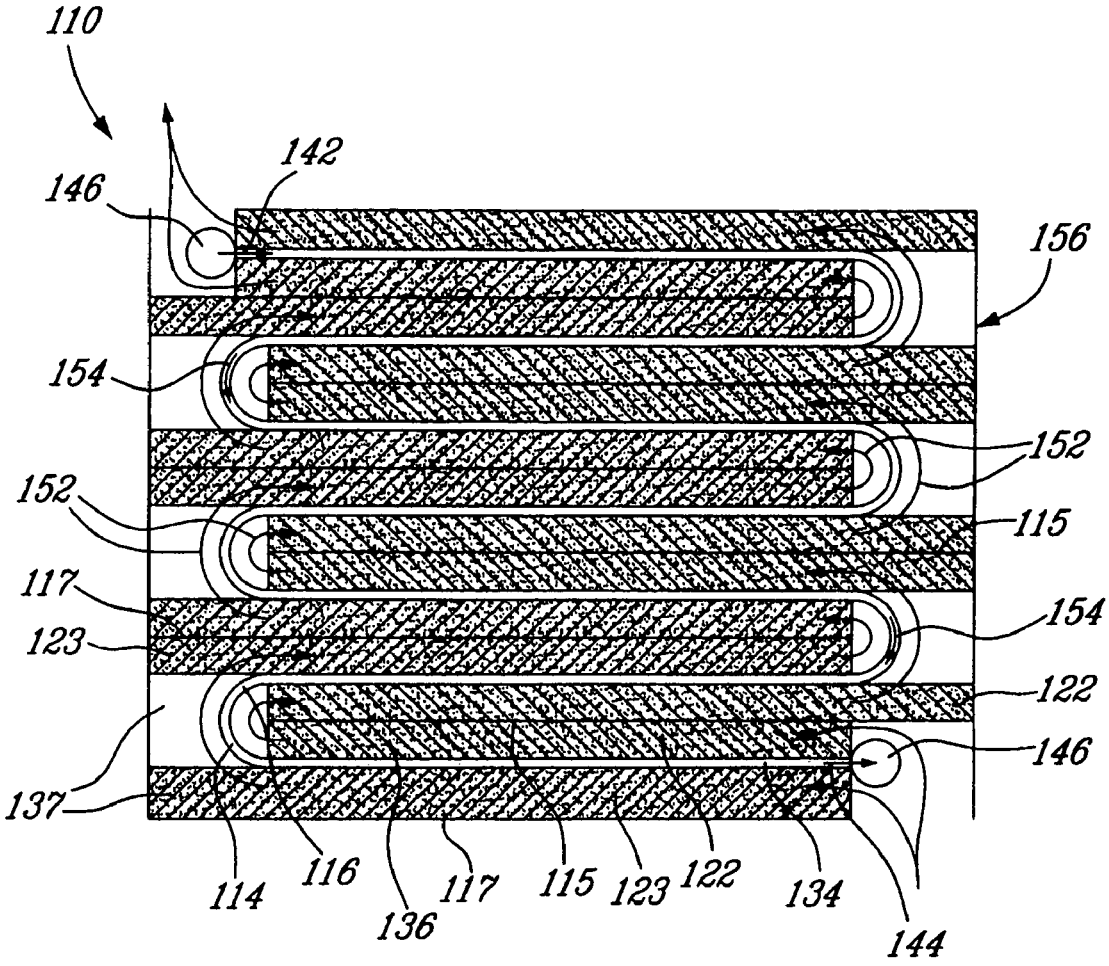
FIG. 6 is a side cross-sectional view of a heat exchanger according to another embodiment of the present invention.

Referring to FIG. 6, another embodiment of the heat exchanger 110 is shown. The heat exchanger 110 has an accordion shape obtained through folding of a flexible heat exchanging assembly 112. The flexible heat exchanging assembly 112 includes, in order: a first sheet of foil material 115, a first sheet of porous material 122, a second sheet of foil material 116, spacers (not shown), a third sheet of foil material 114, a second sheet of porous material 123, and a fourth sheet of foil material 117. The material used are the same as in the previous embodiment.

A plurality of parallel fluid conduits 134 are defined between the inner surfaces of the second and third sheets of foil material 116,114 in the free space between adjacent spacers. The first sheet of porous material 122 is in heat exchange relationship with the second sheet of foil material 116, and the second sheet of porous material 123 is in heat exchange relationship the third sheet of foil material 114. The sheets of porous material 122,123 thus define two elongated air conduits 136, 137, with the fluid conduits 134 extending therebetween.

The first and second sheets of porous material 122,123 are cut into distinct portions at the folds of the heat exchanger 110 in order to facilitate compact folding of the flexible heat exchanging assembly 112. The first and fourth sheets of foil material 115,117 are preferably discontinuous, covering every second one of the portions of their respective sheet of porous material 122,123 so that only one thickness of foil material 115,117 will be located between two adjacent folded portions of the corresponding sheet of foam material 122,123.

To assemble the heat exchanger 10, the still flexible heat exchange assembly 112, with sheets of porous material 122, 123 in their green state, is folded in an accordion manner into a sheet metal container 156. The sheet metal container 156 seals the four sides of the heat exchanger 110 and as such no ribbons or strips are required along the length of the heat exchange assembly 112 as in the previous embodiment. The heat exchanger 110 is then heated so that the different components are sintered and the foam material becomes rigid.

Manifolds 146 are provided at each extremity and connected to the fluid conduits 134 to form an inlet 142 and an outlet 144. In this example, a liquid, such as fuel, flows through the fluid conduits 134 from top to bottom of the heat exchanger 110, as shown by the arrows 154. Air flows trough the air conduits 137 composed of the sheets of foam material 122,123 and the free spaces in between from the top to the bottom of the heat exchanger 110, as shown by the arrows 152. Of course, the heat exchanger 110 could also be used with parallel flows or different flow orientations.

The above description is meant to be exemplary only, and one skilled in the art will recognize that changes may be made to the embodiments described without department from the scope of the invention disclosed. For example, the heat exchange assembly 12 could be folded in an accordion pattern, or the heat exchange assembly 112 could be rolled into a spiral shape. A plurality of heat exchange assemblies 12,112, preferably interconnected, could be use to form a plurality of concentric annular shapes to form an annular heat exchanger. The fluid conduits 34 could extend along an axial direction of the spiral, and the airflow 152 could also be fed therethrough axially, although it is understood that such a configuration would likely be less efficient. Still other modifications which fall within the scope of the present invention will be apparent to those skilled in the art, in light of a review of this disclosure, and such modifications are intended to fall within the appended claims.

The invention claimed is:

1. A method of forming a heat exchanger comprising the steps of:

forming a flexible heat exchanging assembly by:

laying a first flexible sheet composed of heal conducting impermeable material on a support surface;

laying a second flexible sheet composed of beat conducting impermeable material in a spaced apart manner over the first flexible sheet to define at least one elongated conduit for a first fluid flow between the first and second flexible sheets; and laying a third flexible sheet composed of flexible heat conducting foam on the second flexible sheet, the hear conducting foam having a plurality of interconnected pores defining a passage therethrough for a second fluid flow;

shaping the flexible heat exchanging assembly by deformation into a desired shape, including rolling the flexible heat exchanging assembly into a spiral form, the heat exchanger being a spiralling heat exchanger with the at least conduit and the passage extending spirally; and bonding the flexible heat exchanging assembly together to form a rigid heat exchanger, the at least one conduit and the passage extending in a superposed manner throughout the heat exchanger in heat exchange relationship with one another.

2. The method according to claim 1, further comprising laying a plurality of spacers on the first flexible sheet before the step of laying the second flexible sheet, and the second flexible sheet is laid on the plurality of spacers.

3. The method according to claim 2, wherein a step of pre-treating the plurality of spacers with a high temperature alloy powder is performed before the step of bonding, and the step of bonding further comprises heating the flexible heat exchanging assembly to sinter the third flexible sheet with the first and second flexible sheets and the plurality of spacers with the first and second flexible sheets.

4. The method according to claim 1, wherein the step of bonding comprises heating of the flexible heat exchanging assembly.

5. The method according to claim 4, wherein the heating of the flexible heat exchanging assembly comprises sintering of the third flexible sheet with the first and second flexible sheets.

6. The method according to claim 1, wherein the step of bonding transforms the flexible heat conducting foam into a rigid heat conducting foam.

* * * * *

UNITED STATES PATENT AND TRADEMARK OFFICE

CERTIFICATE OF CORRECTION

PATENT NO. : 7,467,467 B2
APPLICATION NO. : 11/239110
DATED : December 23, 2008
INVENTOR(S) : Lev Alexander Prociw It is certified that error appears in the above-identified patent and that said Letters Patent is hereby corrected as shown below:

In the claim:

claim 1, column 7, line 6, delete “heal” insert --heat-- claim 1, column 7, line 8, delete “beat” insert --heat-- claim 1, column 7, line 14, delete “hear” insert --heat--

Signed and Sealed this

Twenty-fourth Day of March, 2009

JOHN DOLL
*Acting Director of the United States Patent and Trademark Office*